US008781386B2

(12) United States Patent
Shimizu et al.

(10) Patent No.: US 8,781,386 B2
(45) Date of Patent: Jul. 15, 2014

(54) PAPER PARTICLE REMOVING DEVICE, AND IMAGE FORMATION DEVICE PROVIDED WITH PAPER PARTICLE REMOVING DEVICE

(75) Inventors: Yoshikazu Shimizu, Aichi (JP); Masafumi Inoue, Gifu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 10 days.

(21) Appl. No.: 13/359,567

(22) Filed: Jan. 27, 2012

(65) Prior Publication Data

US 2012/0195622 A1 Aug. 2, 2012

(30) Foreign Application Priority Data

Jan. 28, 2011 (JP) ..... 2011-017226

(51) Int. Cl.
*G03G 15/00* (2006.01)
*G03G 21/00* (2006.01)

(52) U.S. Cl.
CPC ..... *G03G 15/6558* (2013.01); *G03G 21/00* (2013.01)
USPC ..... 399/388; 399/98

(58) Field of Classification Search
CPC ..... G03G 2215/00708; G03G 15/6558; G03G 21/00
USPC ..... 399/98, 100, 388
See application file for complete search history.

(56) References Cited

U.S. PATENT DOCUMENTS

| | | | | |
|---|---|---|---|---|
| 4,750,018 | A * | 6/1988 | Gooray et al. | 399/390 |
| 6,304,735 | B1 * | 10/2001 | Nishimura et al. | 399/98 |
| 6,628,912 | B2 * | 9/2003 | Amemiya et al. | 399/174 |
| 6,708,009 | B2 * | 3/2004 | Fuwazaki et al. | 399/98 |
| 6,941,091 | B2 * | 9/2005 | Iida et al. | 399/99 |
| 7,634,205 | B2 * | 12/2009 | Jen | 399/34 |
| 2004/0120728 | A1 * | 6/2004 | Ziegelmuller et al. | 399/123 |
| 2009/0052966 | A1 * | 2/2009 | Yamashita et al. | 399/407 |
| 2009/0160120 | A1 * | 6/2009 | Hirose | 271/18 |

FOREIGN PATENT DOCUMENTS

| | | |
|---|---|---|
| JP | 05-197316 | 8/1993 |
| JP | 07-025503 | 1/1995 |
| JP | 2003-323144 | 11/2003 |
| JP | 2006-008386 | 1/2006 |
| JP | 2006-030333 | 2/2006 |

* cited by examiner

*Primary Examiner* — Matthew G Marini
*Assistant Examiner* — John M Royston
(74) *Attorney, Agent, or Firm* — Banner & Witcoff, Ltd.

(57) ABSTRACT

A paper particle removing device is provided with a paper particle removing roller configured to contact a printing sheet to capture paper particles on the printing sheet, a scraping member arranged adjacent to the paper particle removing roller and configured to contact the paper particle removing roller to scrape the paper particles, a paper particle container arranged on a scraping member side with respect to a position where the scraping member contacts the paper particle removing roller, and configured to collect the paper particles scraped by the scraping member, and a negatively-charged member arranged on the scraping member side with respect to a position where the paper particle removing roller contacts the scraping member and having a relative tendency in a triboelectric series to be negatively charged relative to the paper particles, the negatively-charged member inducing the paper particles scraped by the scraping member toward the paper particle container.

16 Claims, 2 Drawing Sheets

7

PAPER PARTICLE REMOVING DEVICE, AND IMAGE FORMATION DEVICE PROVIDED WITH PAPER PARTICLE REMOVING DEVICE

CROSS-REFERENCE TO RELATED APPLICATION

This application claims priority under 35 U.S.C. §119 from Japanese Patent Application No. 2011-017226 filed on Jan. 28, 2011. The entire subject matter of the application is incorporated herein by reference.

BACKGROUND

1. Technical Field

Aspects of the invention relate to an image formation device such as a color laser printer.

2. Related Art

In the image formation device, paper particles are adhered on a printing sheet, which is introduced from a sheet feed tray and has been fed through a sheet feed path. Such paper particles may deteriorate image quality. Therefore, conventionally, an image formation device provided with a paper particle collecting device has been suggested in order to ensure that image formation is performed in an optimum condition.

SUMMARY

An example of the conventional image formation device is provided with a scraper and a collection box. The scraper is movable between a removing position at which the distal end of the scraper contacts a circumferential surface of a roller, which is configured to contact a printing sheet being fed to a photoconductive drum to capture the paper particles thereon, and a collecting position at which the distal end of the scraper is spaced from the surface of the roller. The paper particles transferred from the printing sheet to the roller is scraped by the scraper, and collected in the collection box.

According to the conventional image formation device as described above, the paper particles scraped from the roller may roil in the air and/or may not moved to the collection box and stay on the scraper. In such a case, the paper particles may be scattered inside the image formation device. In such a case, an image formation unit of the image formation device may be smudged by such paper particles, which may result in deterioration of image quality.

In consideration of the above, aspects of the present invention provide an improved image formation device in which roiling of paper particles can be prevented, and thus deterioration of image quality due to paper particles can be suppressed.

According to aspects of the invention there is provided a paper particle removing device for an image formation device. The paper particle removing device is provided with a paper particle removing roller configured to contact a printing sheet to capture paper particles on the printing sheet, a scraping member arranged adjacent to the paper particle removing roller and configured to contact the paper particle removing roller to scrape the paper particles retained on the paper particle removing roller, a paper particle container arranged on a scraping member side with respect to a position where the scraping member contact the paper particle removing roller, and configured to collect the paper particles scraped by the scraping member, and a negatively-charged member arranged on the scraping member side with respect to a position where the paper particle removing roller contacts the scraping member and having a relative tendency in a triboelectric series to be negatively charged relative to the paper particles, the negatively-charged member inducing the paper particles scraped by the scraping member toward the paper particle container.

According to aspects of the invention there is provided an image formation device, which is provided with the paper particle removing device as above.

BRIEF DESCRIPTION OF THE ACCOMPANYING DRAWINGS

DETAILED DESCRIPTION

Figure 1:
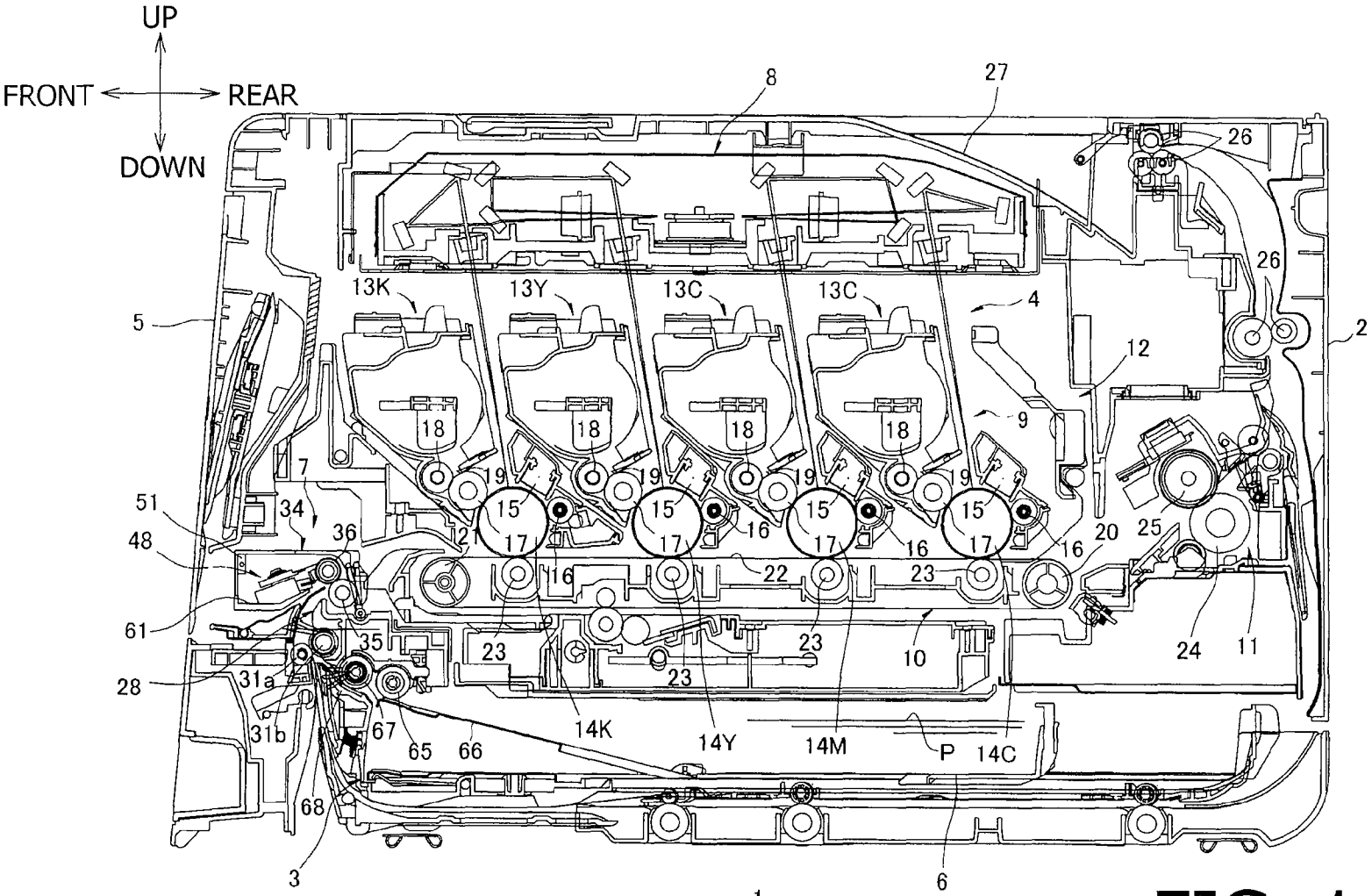
FIG. 1 is a cross-sectional side view of a color laser printer according to an exemplary embodiment of the invention.

Hereinafter, a color laser printer 1 will be described as an exemplary embodiment according to the present invention. As shown in FIG. 1, the color laser printer 1 is a horizontally mounted direct tandem type color laser printer. The color laser printer 1 has a casing 2, which accommodates a sheet feed unit 3 configured to feed printing sheets P and an image formation unit 4 configured to form images on a printing sheet P fed from the sheet feed unit 3.

The casing 2 is a box-like structure having a rectangular cross section. On one side wall of the casing 2, a front cover 5 is provided. The front cover 5 is rotatable, with respect to the casing 2, about an axis which is defined to be at the lower end portion of the front cover 5. By opening the front cover, a process unit 9 (described later) can be inserted in/removed from the casing 2.

Figure 2:
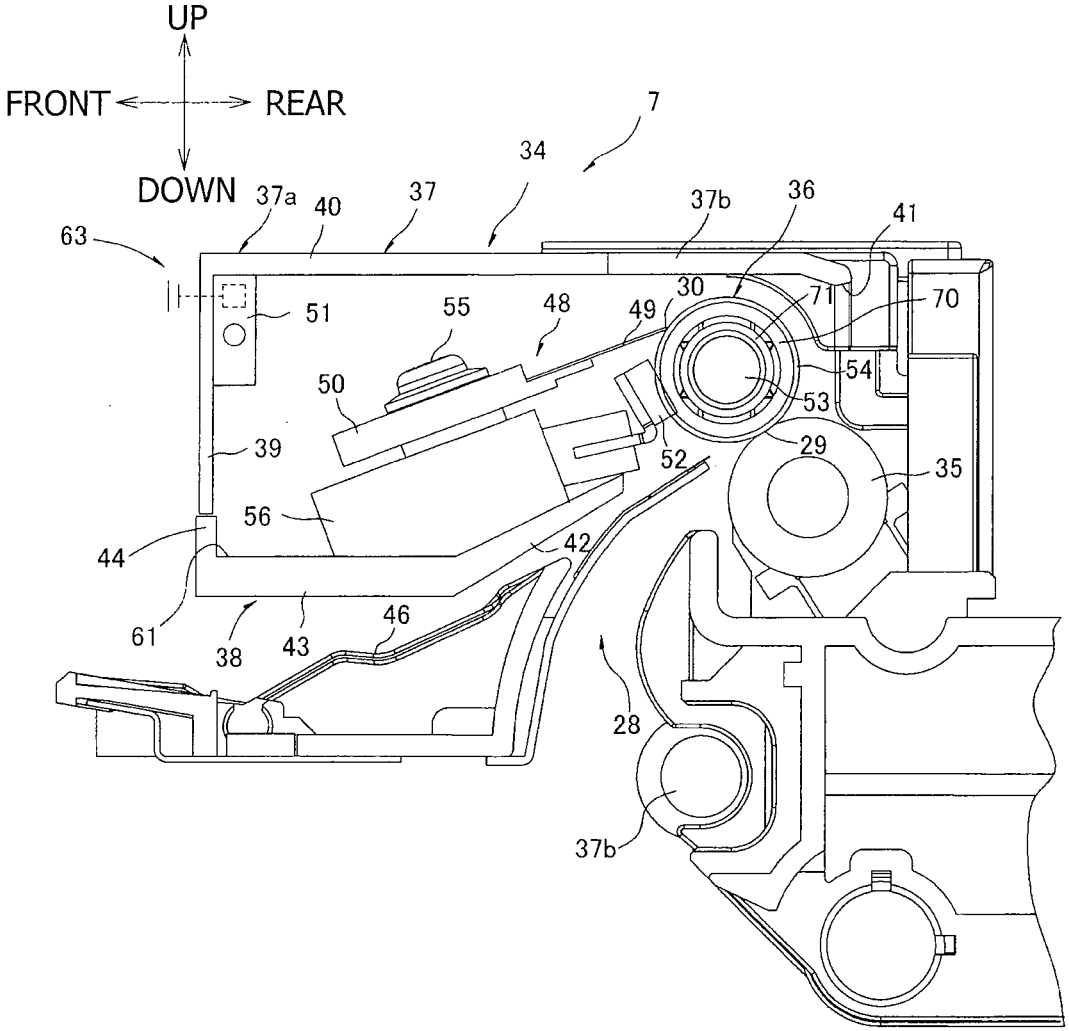
FIG. 2 is an enlarged partial cross-sectional side view of a paper particle removing device employed in the color laser printer shown in FIG. 1.

In the following description, a left-hand side of FIG. 1 will be referred to as a front side of the color laser printer 1, and a right-hand side of FIG. 1 will be referred to as a rear side of the color laser printer 1. Further, right and left side of the color laser printer 1 will be defined as sides viewed from the front side of the color laser printer 1. Thus, a closer side with respect to a plane of FIG. 2 is defined as a right side of the color laser printer 1, while a farther side with respect to a plane of FIG. 2 is defined as left side of the color laser printer 1.

The sheet feed unit 3 is provided with a sheet feed tray 6, a pickup roller 65, and a sheet feed path 28.

The sheet feed tray 6 is placed on the bottom portion of the casing 2, and movable in the front-and-rear direction for attaching to/detaching from the casing 2.

The sheet feed tray 6 is provided with a pressure plate 66. The pressure plate 66 is movable (rockable) about an axis defined at the rear side end portion thereof such that the distal end of the pressure plate 66 moves in an up/down direction.

The printing sheet P are placed on the pressure plate 66 as a stack. A spring member is provided below the pressure plate 66 so that the pressure plate 66 is urged upwardly. Therefore, the pressure plate 66 moves (rotates) downward against the urging force of the spring member as the amount of the stacked printing sheets P increases.

The pickup roller 65 is provided above the front end portion of the sheet feed tray 6. The sheet feed path 28 is defined above the sheet feed tray 6. Along the sheet feed path 28, a separation roller 67, a separation pad 68, a pair of feeding rollers 31*a* and 31*b*, and a register roller 35 are provided (see FIG. 1).

The separation roller 67 and the separation pad 68 are arranged to face each other at a position on a front side of (i.e., downstream side of) the pickup roller 65. The separation pad 68 is biased, by a well-known biasing member (e.g., a spring), such that an upper surface of the separation pad, which is a frictional surface, is urged toward the separation roller 67.

The pair of feed rollers 31*a* and 31*b* are arranged on an upper front side with respect to the separation roller 67 and the separation pad 68.

The register roller 35 is arranged to face a paper particle removing roller 36 such that an upper front portion of the circumferential surface of the register roller 35 is urged toward a lower rear portion of the circumferential surface of the paper particle removing roller 36 which is provided to a paper particle removing device 7.

The sheet feed path 28 is formed such that the upstream side end portion is arranged next to the separation roller 67 and the separation pad 68, while the downstream side end portion is arranged next to the paper particle removing roller 36 and the register roller 35. Thus, the sheet feed path 28 has a substantially U-shaped cross section from its upstream end portion to the downstream end portion.

Among the printing sheets P accommodated in the sheet feed tray 6, the uppermost printing sheet P on the pressure plate 66 is fed by the pickup roller 65, and through the separation roller 67 and separation pad 68, only one sheet of printing sheet P is fed forward. The printing sheet P is further fed by the feeding rollers 31*a* and 31*b*, passing through the sheet feed path 28, and reaches a nip between the paper particle removing roller 36 and the register roller 35. The paper particle removing roller 36 and the register roller 35 feed the printing sheet P, at a predetermined interval with removing the paper particles, to a portion between the image formation unit 4 and a feeding belt 22.

The image formation unit 4 is provided with a scanner unit 8, a process unit 9, a transfer unit 10 and a fixing unit 11.

The scanner unit 8 is arranged at an upper portion of the casing 2. The scanner unit 8 is configured to emit laser beams, based on image data, to four photoconductive drums 14 as indicated by broken lines in FIG. 1 so that the circumferential surfaces of the photoconductive drums 14 are exposed to light corresponding to images to be formed.

The process unit 9 is arranged below the scanner unit 8 and above the transfer unit 10. The process unit 9 is provided with four sets of the photoconductive drum 14 and scorotron-type charger 15, a box-like photoconductive drum supporting member 12 and four developing cartridge corresponding to four colors. The photoconductive drum supporting member 12 is configured to be slidable in the front-and-rear direction as a whole, and detachably attached to the casing 2.

The photoconductive drums 14 are arranged in the front-and-rear direction with a predetermined intervals. In the right-and-left direction, the four photoconductive drums 14 are aligned at the same position. According to the embodiment, the four photoconductive drums 14 includes: a photoconductive drum 14K for forming a black image, a photoconductive drum 14Y for forming a yellow image; a photoconductive drum 14M for forming a magenta image; and a photoconductive drum 14C for forming a cyan image, which are arranged from the front to rear in this order.

The scorotron-type charger 15 is arranged on the upper rear portion of each photoconductive drum 14 to face the photoconductive drum 14 with a predetermined space therebetween.

The drum cleaning roller 16 is arranged on the rear side of each photoconductive drum 14 to face and contact the photoconductive drum 14.

Each developing cartridge 13 is detachably attached to the photoconductive drum supporting member 12 at an upper portion of corresponding photoconductive drum 14. Specifically, from front to rear, the developing cartridges for black (13K), yellow (13Y), magenta (13M) and cyan (13C) are arranged in this order. Further, each developing cartridge 13 is provided with a developing roller 17.

The developing roller 17 is rotatably supported such that it is exposed at the lower rear portion of each developing cartridge 13, and contacts the corresponding photoconductive drum 14 from the above.

It is noted that each developing cartridge 13 contains a supply roller 18 which supplies toner to the developing roller 17, and a thickness restriction blade 19 which restricts the thickness of the toner supplied to the developing roller 17. Further, each developing cartridge 13 contains toner corresponding to the photoconductive drum 14 at a space above the supply roller 18.

The toner inside the developing cartridge 13 is supplied to the supply roller 18, and then supplied to the developing roller 17. When transferred, the toner is frictionally charged positively between the supply roller 18 and the developing roller 17.

As the developing roller 17 rotates, thickness of the toner supplied onto the developing roller 17 is restricted by the thickness restriction blade 19 so that the toner is carried by the developing roller 17 as a thin layer having a predetermined thickness.

The circumferential surface of each photoconductive drum 14 is uniformly charged by the scorotron-type charging device 15 as the photoconductive drum 14 rotates. Then, the circumferential surface of the photoconductive drum is exposed to the scanning laser beam, which is emitted from the scanner unit (see broken lines in FIG. 1). As exposed to the scanning laser beam, an electrostatic latent image corresponding to the image to be formed on the printing sheet P is formed on the circumferential surface of each photoconductive drum 14.

As each photoconductive drum 14 further rotates, the positively charged toner carried on the surface of the developing roller 17 is supplied onto the latent image formed on the surface of the photoconductive drum 14. As a result, the latent image on each photoconductive drum 14 is developed (turned to a visibly recognizable image), that is, a toner image according to a reversal development is carried on the circumferential surface of each photoconductive drum 14.

The transfer unit 10 is arranged, inside the casing 2, at a position above the sheet feed unit 3, below the process unit 9, and extend in the front-and-rear direction. The transfer unit 10 includes a belt drive roller 10, a driven roller 21, a feeding belt 22 and four transfer rollers 23.

The belt drive roller 20 and the driven roller 21 are aligned to oppose to each other in the front-and-rear direction with a predetermined distance therebetween.

The feed belt 22 is faces the photoconductive drums 14 in the up-and-down direction. Specifically, the feed belt 22 is an endless belt member wound around the drive roller 20 and driven roller 21. The upper part of the feed belt 22 contacts the photoconductive drums 14. The feed belt 22 moves around the drive roller 20 and the drive roller 21. That is, as the drive roller 20 operates to rotated, the upper part of the feed belt 22 moves from front to rear, while the lower part of the feed belt 22 moves from rear to front.

Each transfer roller 23 is arranged to face the corresponding photoconductive drum 14 with the upper part of the feed belt 22 located therebetween.

The printing sheet P fed from the sheet feed unit 3 is fed by the feed belt 22, from the front to rear, so that the printing sheet P subsequently passes through the transfer positions where the photoconductive drums 14 and the transfer rollers 23 face with each other, respectively. When the printing sheet P is fed, the toner carried by respective photoconductive drums 14 are subsequently transferred onto the printing sheet P, thereby a color image being transferred on the printing sheet P.

The fixing unit 11 is arranged on the rear side with respect to the transfer unit 10. The fixing unit 11 includes a heat roller 24, and a pressure roller 25 which faces and is biased toward the heat roller 24. The color image transferred on the printing sheet P by the transfer unit 10 is fixed on the printing sheet P as heat and pressure are applied when the printing sheet P passes through the nip between the heat roller 24 and the pressure roller 25.

The printing sheet P on which the toner image is fixed is fed, by the discharge rollers 26, to pass the U-turn passage, and discharged on a discharge tray 27 formed above the scanner unit 8.

The sheet feed unit 3 is further provided with a paper particle removing device 7 (see FIG. 2).

The paper particle removing device 7 is arranged on the front side with respect to the register roller 35. The paper particle removing device 7 includes a frame 34, a paper particle removing roller 36, a mount 56, a scraping blade 48, a negatively-charged resin 51, and a paper particle container 61.

The frame 34 has a substantially rectangular cross-section, extending in the right-and-left direction, and both ends thereof are closed by right and left walls of the casing 2, respectively.

The frame 34 is formed with an upper cover 37 and the lower cover 38. The upper cover 37 includes a first upper cover 37*a* arranged on the front side, and the second upper cover 37*b* arranged on the rear side.

The first upper cover 37*a* has a substantially L-shaped cross section and has an upper wall 40 and a side wall 39.

The upper wall 40 is formed to extend in the front-and-rear direction. The side wall 39 is formed to extend downward from the front end of the upper wall 40 at a right angle.

The second cover 37*b* is formed rearward from the rear end of the upper wall 40.

The lower cover 38 has a substantially L-shaped cross section, and a length thereon in the front-and-rear direction is shorter than that of the upper cover 37. The lower cover 38 includes a front lower wall 43, a rear lower wall 42, and a front wall 44.

The front lower wall 43 is formed to extend in the front-and-rear direction. The rear lower wall 42 extends along the sheet feed path 28 from the rear end of the front lower wall 43, and is formed to extend obliquely in the upper rear direction.

The front wall 44 is formed to extend upward from the front end of the front lower wall 43 at a right angle.

The first upper cover 37*a* and the lower cover 38 are formed of polystyrene (PS). The polystyrene tends to be charged negatively relative to the paper particle in the triboelectric series. That is, material of the first upper cover 37*a* and the lower cover 38 is selected so that they tend to be charged positively relative to the paper particles in the triboelectric series.

The lower end of the side wall 39 and the upper end of the front wall 44 are connected over an entire length in the right-and-left direction. With this configuration, the front side of the frame 34 is closed. The rear lower side of the frame 34 is obliquely cut out so that the rear side of the frame 34 is formed to be narrowed toward the rear side.

An opening 41 is formed between the rear end of the second upper cover 37*b* and the rear lower wall 42. The opening 41 is opened obliquely toward a lower rear side on the lower rear side of the frame 34.

The paper particle removing roller 36 is arranged at a rear side in the frame 34 such that in a projection in the up-and-down direction and in a projection in the front-and-rear direction, the paper particle removing roller 36 located within the opening as a whole.

The upper circumferential surface of the paper particle removing roller 36 faces the lower surface of the second upper cover 37*b* with a certain clearance therebetween, and the lower and rear side circumferential surface views the sheet feed path 28.

Further, the paper particle removing roller 36 includes a metallic roller shaft 53, a metallic hollow shaft 70 which is coaxially arranged with the metallic roller shaft 53, a resin cap 71 which is engaged with both the roller shaft 53 and the hollow shaft 70, and a fluorocarbon resin roller 54 coating on the hollow shaft 70.

The roller shaft 53 extends in the right-and-left direction, both ends being rotatably supported by both side walls of the casing 2 (not shown). A driving force diverged from the rotation input shaft of the register roller 35 is transmitted to the roller shaft 53.

The paper particle removing roller 36 is arranged such that the lower rear circumferential surface of the fluorocarbon resin roller 54 is press-contacted with the upper front circumferential surface of the register roller 35. When the printing sheet P is fed, a driving force for a motor (not shown) is transmitted to the roller shaft 53, and at a position (nip) 29 where the paper particle removing roller 36 contacts the register roller 35, the paper particle removing roller 36 is driven to move in a direction indicated by an arrow (i.e., in a counterclockwise direction viewed from the right) in FIG. 1.

The mount 56 is formed of polystyrene and arranged above the rear lower wall 42 and the front lower wall 43, on the front side, with a certain clearance, of the front-side end of the opening 41.

The mount 56 has a substantially rectangular shape over the entire range in the right-and-left direction.

The scraping blade 48 is supported on the mount 56. The scraping blade 48 is a planar plate like member extending in the right-and-left direction. The scraping blade 48 includes a rigid portion 50 made of metal and an elastic portion 49 made of PET (polyethylene terephthalate).

The rigid portion 50 has a thick plate-like shape and secured onto the upper surface of the mount 56 with screws 55.

The elastic portion 49 has a flexible film-like portion, the proximal end thereof being supported by the rear end of the rigid portion 50. The elastic portion 49 is arranged to protrude rearward from the rigid portion 50 so that the distal end of the elastic portion 49 contacts the front upper circumferential surface of the fluorocarbon resin roller 54 from the lower front portion thereof.

A sponge member 52 is formed with urethane resin, and arrange below the elastic portion 49, and on the front side of the paper particle removing roller 36. The sponge member 52 is rotatably secured to the frame 34, and urged to the paper particle removing roller 36 with a spring. It is noted that such an urging structure is well-known and not shown in the drawings for brevity.

The rear surface of the sponge member 52 contacts the front side circumferential surface of the fluorocarbon resin roller 54 from below at a position, in the rotational direction of the paper particle removing roller 26, between a scraping position 30 and the nip 29.

The negatively-charged resin 51 is formed of ABS (acrylonitrile butadiene styrene) resin, which has a rectangular cross section of which the up-and-down side is a longer side of the rectangle. The negatively-charged resin 51 is supported by the side wall 39 such that the front surface thereof contacts the rear surface of the side wall 39, and the upper surface thereof contacts the lower surface of the upper wall 40. The negatively-charged resin 51 is arranged on the front side with respect to the rigid portion 50 and the mount 56, and the lower surface thereof faces the paper particle container 61. Thus, the negatively-charged resin 51 is arranged to be spaced on the front side with respect to the scraping point 30, the elastic portion 49 and the rigid portion 50.

The ABS resin relatively tends to be negatively charged, in the triboelectric series, relative to the paper particle, the polystyrene of first upper cover 37*a* and lower cover 38, and the mount 56, the metal of the rigid portion 50, the PET of the elastic portion 49, and the urethane resin of the sponge member 52. In other words, material of the negatively-charged resin 51 is selected so that it tends to be negatively charged, in the triboelectric series, relative to the paper particle, the first upper cover 37*a* and lower cover 38, and the mount 56, the rigid portion 50, the elastic portion 49, and the sponge member 52.

The paper particle container 61 is arranged below the negatively-charged resin 51. The paper particle container 61 has the side wall 39, a front wall 44 and a front lower wall 43, which define a space for accumulating the paper particles.

It is noted that, below the negatively-charged resin 51, a manual feed path 46 is formed. The printing sheet P fed from a manual feed tray (not shown) is fed to the nip between the register roller 35 and the paper particle removing roller 36 through the manual feed path 46. The manual feed path 46 is formed along the bottom surfaces of the front lower wall 43 and rear lower wall 42, and is converged with the sheet feed path 28 at an immediate front position with respect to the nip 29.

In the color laser printer 1, when the printing sheet P is being fed, the paper particle removing roller 36 rotates as the register roller 35 rotates and the driving force diverged from the rotational force input shaft of the register roller 35 is applied to a rotational force input shaft of the paper particle removing roller 36. At this stage, since the circumferential surface of the fluorocarbon resin roller 54 slidably contacts the sponge member 52, the fluorocarbon resin roller 54 is charged effectively.

As described above, when the printing sheet P accommodated in the sheet feed tray 6 is fed and reaches the nip between the paper particle removing roller 36 and the register roller 35, the printing sheet P is sandwiched by the paper particle removing roller 36 and the register roller 35, and the paper particles on the printing sheet P are captured (attracted) by the fluorocarbon resin roller 54.

As the paper particle removing roller 36 rotates and the attracted paper particles reach the scraping position 30, the paper particles are scraped by the scraping blade 48. The scraped paper particles move forward along the upper surface of the scraping blade 48, and introduce in the paper particle container 61.

Since the first upper cover 37*a* tends to be negatively charged, in the triboelectric series, relative to the paper particles, the paper particles firstly are attracted to the lower surface of the first upper cover 37*a*. At this stage, the rear end of the first upper cover 37*a* is located on the front side of the scraping position 30, the paper particles moved forward (i.e., toward the paper particle container 61). The paper particles attracted to the first upper cover 37*a* then move toward the negatively-charged resin 51 (i.e., move forward). The negatively-charged resin 51 tends to be negatively-charged, in the triboelectric series, relative to the first upper cover 37*a*. Therefore, the paper particles are moved forward and attracted by the negatively-charged resin 51. The paper particles thus attract and accumulated on the negatively-charged resin 51 then fall down from the negatively-charged resin 51 and accumulate in the paper particle container 61.

As described above, the color laser printer 1 is provided with the paper particle removing device 7 which includes the paper particle removing roller 36, the scraping blade 48, the paper particle container 61, the first upper cover 37*a* and the negatively-charged resin 51.

In the paper particle removing device 7, the first upper cover 37*a*, the negatively-charged resin 51 and the paper particle container 62 are arranged on the scraping blade 38 side with respect to the scraping position 30.

With the above configuration, when the scraping blade 48 contacts the paper particle removing roller 36 and scrapes the paper particles adhered on the paper particle removing roller 36, the paper particles are attracted on the bottom surface of the first upper cover 37*a*. Then, the paper particles are moved forward by the negatively-charged resin 51, accumulated thereon, and falls down into the paper particle container 61. Therefore, according to such a configuration, the scraped paper particles are not scattered inside the laser beam printer 1. Thus, deterioration of images due to the paper particles can be suppressed.

Specifically, according to the exemplary embodiment, the first upper cover 37*a* and the negatively-charged resin 51 are arranged on the side farther from the scraping position 30, with respect to the paper particle removing roller 36, toward the paper particle container 61 side. Therefore, the paper particles are introduced, via the bottom surface of the first upper cover 37*a*, to the position above the paper particle container 61 by the negatively-charged resin 51. Therefore, introducing the paper particles to a position sufficiently spaced from the opening 41 on the front side, the paper particles can be accumulated in the paper particle container 61. Therefore, a possibility of scattering of the paper particles inside the color laser printer 1 can be reduced.

According to the exemplary embodiment, the first upper cover 37*a*, the lower cover 38 and the negatively-charged resin 51 are formed with appropriate materials in view of the triboelectric series. Specifically, materials are selected such that the first upper cover 37*a* , the lower cover 38 and the negatively-charged resin 51 exhibit tendency to be negatively charged, in triboelectric series, relative to the paper particles. Therefore, by selecting appropriate materials, the paper particles can be introduced to the paper particle container 61 with electric induction.

The color laser printer 1 according to the exemplary embodiment is configured such that the relative tendency to be negatively charged according to the triboelectric series is greater for the paper particle container 61 than for the paper particles. In other words, the material of the paper particle container 61 is selected so that the relative tendency to be negatively charged according to the triboelectric series is smaller for the paper particles than for the paper particle container 61.

With the above configuration, the paper particles accumulated in the paper particle container 61 is electrically attracted by the paper particle container 61, outflow of the paper particles once accumulated in the paper particle container 61 is prevented.

The color laser printer 1 according to the exemplary embodiment is configured such that the paper particle removing roller 36 is provided with the roller shaft 53, the hollow shaft 70, the cap 71 and the fluorocarbon resin roller 54. Since the fluorocarbon resin 54 is well charged, the paper particles on the printing sheet P can be captured effectively.

Further, according to the exemplary embodiment, the sponge member 52 which contacts the paper particle removing roller 36 is provided at a position, in the rotational direction of the paper particle removing roller 36, between the scraping position 30 and the nip 29. Therefore, it is possible to charge the paper particle removing roller 36 after the paper particles are removed by the scraping blade 48. With this configuration, since the charged portion of the paper particle removing roller 36 always contacts the printing sheet P, the paper particles on the printing sheet P can be captured effectively.

Furthermore, since the color laser printer 1 is provided with the scraping blade 48, the paper particles captured by the paper particles removing roller 36 can be scraped effectively.

According to the exemplary embodiment, the ABS resin is employed as the negatively-charged resin 51, which tends to be negatively-charged, in the triboelectric series, relative to the paper particles. The invention needs not be limited to such a configuration, and can be modified in various ways without departing from the scope of the invention. For example, without employing the ABS resin, an electrode 63, which is indicated in FIG. 2 by phantom lines, may be provided to apply bias voltage to the negatively-charged resin 51. In such a case, even if the material of the negatively-charged resin 51 has a tendency to be charged positively, in the triboelectric series, relative to the paper particles, the paper particles can be captured by the negatively-charged resin 51 effectively.

In the modification, the electrode 63 is provided to the casing 2 so as to be electrically connected to the negatively-charged resin 51.

It is of course possible to employ the electrode 63 even when the ABS resin is used for the negatively-charged resin 51.

In the exemplary embodiment, the register roller 35 and the paper particle removing roller 36 constitute a pair of register rollers. The invention needs not be limited to such a configuration, and can be modified. For example, the paper particle removing device 7 may be coupled to the feed roller 31.

In the exemplary embodiment, the laser printer is the color laser printer provided with a plurality of photoconductive drums, transfer rollers and the like. It is noted that the invention needs not be limited to such a configuration, and can be modified. For example, the printer to which the invention is applied may be a monochrome printer provided with a single photoconductive drum, single transfer roller and the like.

What is claimed is:

1. A paper particle removing device for an image formation device, comprising:

a paper particle removing roller having a rotational axis and configured to contact a printing sheet to capture paper particles on the printing sheet, wherein the paper particle removing roller is configured to contact the printing sheet at a first location with respect to the rotational axis;

a scraping member arranged adjacent to the paper particle removing roller and configured to contact the paper particle removing roller to scrape the paper particles retained on the paper particle removing roller, wherein the scraping member is configured to contact the paper particle removing roller at a second location with respect to the rotational axis, wherein the second location is approximately 180° downstream of the first location;

a paper particle container arranged on a scraping member side with respect to a position where the scraping member contacts the paper particle removing roller, and configured to collect the paper particles scraped by the scraping member; and a negatively-charged member separated from the paper particle removing roller and arranged on the scraping member side with respect to a position where the paper particle removing roller contacts the scraping member and having a relative tendency in a triboelectric series to be negatively charged relative to the paper particles, the negatively-charged member inducing the paper particles scraped by the scraping member toward the paper particle container.

2. The paper particle removing device according to claim 1, wherein the scraping member includes an elastic portion configured to contact the paper particle removing roller, and a rigid portion formed on an opposite side with respect to a side where the scraping member contacts the paper particle removing roller, and wherein the negatively-charged member is arranged at a position farther from the paper particle removing roller than the elastic portion.

3. The paper particle removing device according to claim 1, wherein the negatively-charged member is formed of material make use of relative tendency of charge in accordance with the triboelectric series.

4. The paper particle removing device according to claim 1, wherein the negatively-charged member is provided with an electrode configured to apply a biasing voltage to the negatively-charged member.

5. The paper particle removing device according to claim 1, wherein a relative tendency of the paper particles in the triboelectric series to be charged negatively is smaller than that of the paper particle container.

6. The paper particle removing device according to claim 1, wherein the paper particle removing roller includes:

a metallic roller shaft;

a hollow metallic shaft arranged coaxially with the metallic roller shaft;

a cap made of resin and configured to engage with both the metallic roller shaft and the hollow metallic shaft in a coaxial state; and a fluorocarbon resin coating around the hollow metallic shaft.

7. The paper particle removing device according to claim 1, further comprising a sponge member configured to charge the paper particle removing roller, wherein the sponge member being arranged between a contact point where the scraping member contacts the paper particle removing roller and another contact point where the paper particle removing roller contacts the printing sheet.

8. The paper particle removing device according to claim 1, wherein the scraping member is a scraping blade.

9. An image formation device, comprising a paper particle removing device, the paper particle removing device comprising:

a paper particle removing roller having a rotational axis and configured to contact a printing sheet to capture paper particles on the printing sheet, wherein the paper particle removing roller is configured to contact the printing sheet at a first location with respect to the rotational axis;

a scraping member arranged adjacent to the paper particle removing roller and configured to contact the paper particle removing roller to scrape the paper particles retained on the paper particle removing roller, wherein the scraping member is configured to contact the paper particle removing roller at a second location with respect to the rotational axis, wherein the second location is approximately 180° downstream of the first location;

a paper particle container arranged on a scraping member side with respect to a position where the scraping member contacts the paper particle removing roller, and configured to collect the paper particles scraped by the scraping member; and a negatively-charged member separated from the paper particle removing roller and arranged on the scraping member side with respect to a position where the paper particle removing roller contacts the scraping member and having a relative tendency in a triboelectric series to be negatively charged relative to the paper particles, the negatively-charged member inducing the paper particles scraped by the scraping member toward the paper particle container.

10. The image formation device according to claim 9, wherein the scraping member includes an elastic portion configured to contact the paper particle removing roller, and a rigid portion formed on an opposite side with respect to a side where the scraping member contacts the paper particle removing roller, and wherein the negatively-charged member is arranged at a position farther from the paper particle removing roller than the elastic portion.

11. The image formation device according to claim 9, wherein the negatively-charged member is formed of material make use of relative tendency of charge in accordance with the triboelectric series.

12. The image formation device according to claim 9, wherein the negatively-charged member is provided with an electrode configured to apply a biasing voltage to the negatively-charged member.

13. The image formation device according to claim 9, wherein a relative tendency of the paper particles in the triboelectric series to be charged negatively is smaller than that of the paper particle container.

14. The image formation device according to claim 9, wherein the paper particle removing roller includes:

a metallic roller shaft;

a hollow metallic shaft arranged coaxially with the metallic roller shaft;

a cap made of resin and configured to engage with both the metallic roller shaft and the hollow metallic shaft in a coaxial state; and a fluorocarbon resin coating around the hollow metallic shaft.

15. The image formation device according to claim 9, wherein the paper particle removing device further comprise a sponge member configured to charge the paper particle removing roller, and wherein the sponge member being arranged between a contact point where the scraping member contacts the paper particle removing roller and another contact point where the paper particle removing roller contacts the printing sheet.

16. The image formation device according to claim 9, wherein the scraping member is a scraping blade.

* * * * *